United States Patent [19]

Wu

[11] Patent Number: 4,989,625

[45] Date of Patent: Feb. 5, 1991

[54] STABLY-RETAINED AUTOMATIC UMBRELLA

[76] Inventor: Tsun-Zong Wu, No. 16, Chen Tai Road, Sec 3, Wu-Ku Hsiang, Taipei Hsien, Taiwan, 24801

[21] Appl. No.: 579,036

[22] Filed: Sep. 7, 1990

[51] Int. Cl.[5] ..... A45B 25/14

[52] U.S. Cl. ..... 135/22; 135/24

[58] Field of Search ..... 135/22–24, 135/20 M

[56] References Cited

U.S. PATENT DOCUMENTS 3,658,077 4/1972 Sato ..... 135/22

3,856,030 12/1974 Sato ..... 135/22

4,941,494 7/1990 Wu ..... 135/22 X

*Primary Examiner*—David A. Scherbel

*Assistant Examiner*—Lan Mai

[57] ABSTRACT

An automatic umbrella includes a plurality of ribs respectively pivotally secured to a plurality of ferrules respectively mounted or held on a telescopic central shaft, an opening tensioning spring formed in the central shaft for opening the umbrella, and at least a retraction restoring spring for closing the umbrella, in which a lower ferrule pivotally connecting one of the ribs is engageable with a hook portion of a controller formed in the grip when closing the umbrella for stably retaining the umbrella ribs especially when folded.

5 Claims, 3 Drawing Sheets

STABLY-RETAINED AUTOMATIC UMBRELLA

BACKGROUND OF THE INVENTION

A simply-constructed automatic umbrella for preventing false operation was disclosed by the present inventor for improving the drawbacks of conventional automatic umbrellas such as taught by U.S. Pat. Nos. 4,421,133; 4,535,374; 4,823,821 and 4,825,888, and was previously filed in U.S. Patent Office on Oct. 23, 1989, given a Ser. No. of 07/425,462. However, such a simply-constructed automatic umbrella (425,462) filed by the same inventor of the application still has a drawback as shown in prior art of FIG. 4.

When carrying the grip G of umbrella of the prior art as shown in FIG. 4 by inverting the upper notch N and runner R downwardly to pose the ribs A upwardly, the ribs A will be easily opened in direction O since the pivotal connections of the ribs are all located at the "lower" position of the central shaft S, causing an inconvenient carrying of the umbrella by the easily opened umbrella and easily obstructing any environmental facilities due to the opened ribs.

The present inventor has found the drawbacks of the prior art and invented the present stably-retained automatic umbrella.

SUMMARY OF THE INVENTION

The object of the present invention is to provide an automatic umbrella including a plurality of ribs respectively pivotally secured to a plurality of ferrules respectively mounted or held on a telescopic central shaft, an opening tensioning spring formed in the central shaft for opening the umbrella, and at least a retracton restoring spring for closing the umbrella, in which a lower ferrule pivotally connecting one of the ribs is engageable with a hook portion of a controller formed in the grip when closing the umbrella for stably retaining the umbrella ribs especially when folded.

BRIEF DESCRIPTION OF THE DRAWINGS

FIG. 3 shows a folded umbrella of the present invention when foldably restored from FIG. 2.

DETAILED DESCRIPTION

Figure 1:
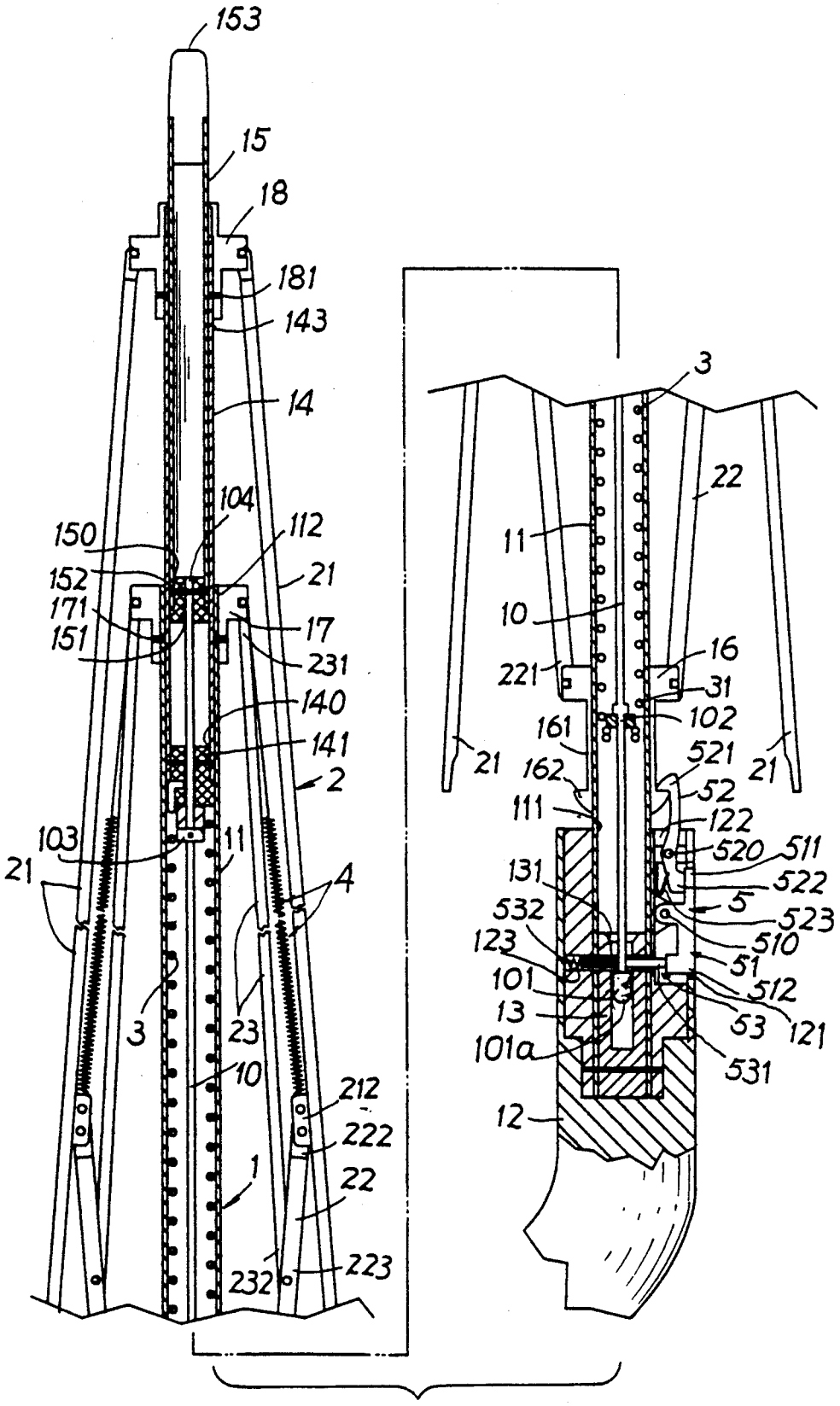
FIG. 1 is an illustration showing a folded umbrella of the present invention.
Figures 1A, 2, 4:
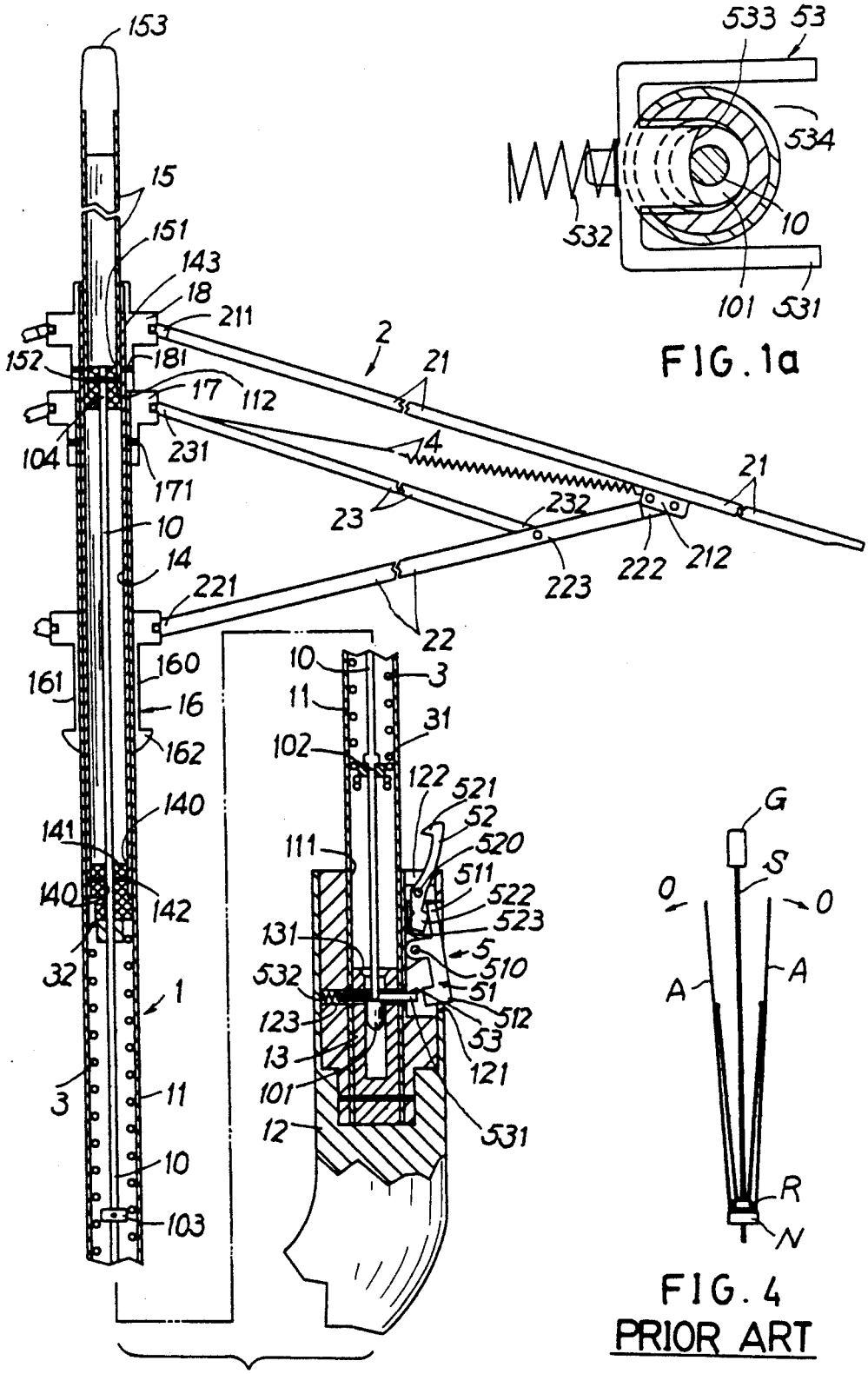
FIG. 4 PRIOR ART
FIG. 1*a* shows a locking head of a central rod engaged with a sliding latch of a control means of the present invention.
FIG. 2 shows an opening umbrella of the present invention.
FIG. 4 is a prior art of automatic umbrella.

As shown in FIGS. 1–3, the present invention comprises: a central shaft means 1, a rib assembly 2 for securing an umbrella cloth thereon, an opening tensioning spring 3 for opening the umbrella, at least a retraction restoring spring 4 for closing the umbrella, and a control means 5 for the control of opening or closing of the umbrella.

The central shaft means 1 includes: a lower tubular shaft 11, a grip 12, a lowr sleeve 13 fixed in a lower portion of the lower shaft 11, a middle tubular shaft 14 telescopically mounted in the lower shaft 11, an upper tubular shaft 15 telescopically mounted in the middle shaft 14, a lower ferrule 16 slidably held on the lower shaft 11, a middle ferrule 17 fixed on an upper end portion 112 of the lower shaft 11 by a pin 171, and an upper ferrule 18 secured on an upper end portion 143 of the middle shaft 14 by a pin 181.

The lower tubular shaft 11 has its lower portion 111 inserted in a central shaft hole formed in the grip 12. The lower sleeve 13 includes an upper taper opening 131 for smoothly guiding a locking head 101 of a central rod 10 formed in the central shaft means 1 into the lower sleeve 13.

The central rod 10 includes a locking head 101 having taper bottom portion **101*a* formed on a lowermost end of the rod 10, a lower retainer 102 positioned above the head 101 secured with a lower spring end portion 31 of the tensioning spring 3, an upper retainer 103 formed on an upper portion of the rod 10 for retaining a middle plug 141 secured on a lower end portion 140 of the middle shaft 14, and an uppermost end portion 104 secured with an upper plub 151 which is secured on a lower portion 150 of the upper shaft 15 by a pin 152**.

The middle plug 141 is formed with a central rod hole 140 for freely passing the rod 10 when operating the ubrella of the present invention. The plug 141 is fixed with the middle shaft 14 by a pin 142 for securing an upper spring end portion 32 of the tensioning spring 3.

The rib assembly 2 includes at least a top rib 21 having its inner end portion 211 pivotally secured to the upper ferrule 18, at least a stretcher rib 22 having an inner end portion 221 pivotally secured to the lower ferrule 16 and having an outermost end portion 222 pivotally secured to an outer portion 212 such as a lug as shown in FIG. 2, and at least an intermediate linking rib 23 having an inner end portion 231 pivotally secured to the middle ferrule 17 and having an outer end portion 232 pivotally connected with an outer portion 223 of the stretcher rib 22. The retraction restoring spring 4 is secured between the middle ferrule 17 and the outer portion or a pivotal joint 212 pivotally connecting the stretcher rib 22 with the top rib 21 for resiliently folding the ribs 2 towards the central shaft means 1 when closing the umbrella of the present invention. Other locations or modifications of the restoring spring 4 may be made on the rib 2 in accordance with the present invention. The lower ferrule 16 includes a cylindrical sleeve 161 having a central hole 160 formed therein for freely moving on the lower shaft 11, and an extension ring 162 tapered downwardly to be engaged with a hook portion 521 of the control means 5. A central head portion 153 is formed on a top portion of the upper shaft 15.

The control means 5 includes: a push button 51, an opening controller 52 for controlling the extension of the ribs 2 and the opening of the umbrella, and a closing controller 53 for the control of the retraction of the ribs 2 and closing of the umbrella.

The push button 51 is pivotally mounted by a pin 510 in a button hole 121 formed in a side portion of the grip 12, having an upper lever 511 operatively depressing the opening controller 52 and a lower lever 512 operatively depressing the closing controller 53.

The opening controller 52 generally formed as a biasing lever has its middle portion pivotally secured in a socket 122 in the grip 12 above the button 51 by a pin 520, its upper portion formed as a hook portion 521 engageable with the extension ring 162 of lower ferrule and its lower portion formed as a depression block 522 resiliently retained by an upper spring 523 secured in the grip 12 and operatively depressed by the upper lever 511 of the push button 51. The spring 523 normally urges the lower depressing block 522 outwardly to bias the upper hook portion 521 inwardly to engage the extension ring 162 on the ferrule 16.

The closing controller 53 includes: a sliding latch 531 as shown in FIG. 1*a* transversely sliding a a lateral slot 123 formed in a lower portion of the grip 12 and resiliently held in the slot 123 by a lower spring 532 which urges the sliding latch 531 outwardly, having an arcuate tongue plate 533 for normally locking a locking head 101 formed on a lower end portion of the central rod 10. The tongue plate 533 is recessed from an outer portion of latch 531 to form a notch 534 as shown in FIG. 1*a*. The central rod 10 is slidably held in the shaft means 1 having the lower locking head 101 having a diameter larger than that of the rod 10 with a taper portion 101*a* formed on its lowest end portion.

The automatic umbrella as shown in FIG. 1 is closed by folding the ribs towards the central shaft means 1 in which the stretcher rib 22 and lower ferrule 16 are pulled downwardly and the upper ferrule 18, top rib 21 and the middle shaft 14 are pulled upwardly along the shaft means 1 to extend to the tensioning spring 3 to store its elastic potential energy until the extension ring 162 of the lower ferrule 16 is engaged with the hook portion 521 of the control means 5 for stabilizing a folded umbrella as shown in FIG. 1.

When it is intended to open the umbrella from FIG. 1 to FIG. 2, the upper lever 511 of the push button 51 is depressed inwardly to bias the hook portion 521 outwardly to disengage the extension ring 162 of ferrule 16 so that the tensioning spring 3 will release its elastic energy to retract the spring 3, the middle shaft 14 to lower the upper ferrule 18 and top ribs 21, relative to an upward raising of middle ferrule 17, linking ribs 23, lower ferrule 16 and stretcher ribs 22 so as to extend the ribs 2 and open the umbrella as shown in FIG. 2. During the extending of the ribs 21, 22, 23, the retraction restoring spring 4 is tensioned to store its elastic potential energy which tends to urge the middle ferrule 17 and lower ferrule 16 downwardly against the upper ferrule 18 to restore the retraction of the ribs 2, but is retarded by the tensioning spring 3 retained between the plug 141 and the latch 531 thereby stably keeping an opening umbrella.

For closing the opened umbrella of the present invention from FIG. 2 to FIG. 3, the lower lever 512 of the push button 51 is depressed to retract the sliding latch 531 to disengage the tongue plate 53 from the locking head 101 of the central rod 10 to unlock the restoring operation of springs 4. The restoring springs 4 will restore to lower the ferrule 17, 16 to retract the ribs 23, 22, 21 towards the central shaft means 1 to close the umbrella as shown in FIG. 3. The downward sliding of lower ferrule 16 will cause an engagement of its extension ring 162 with the hook portion 521 of the control means 5.

The grip 12 is depressed against the head portion 153 on the upper shaft 15 to extend the tensioning spring 3 as retained between a lower retainer 102 and a middle plug 141 limited by an upper retainer 103 to store an elastic potential energy of the spring 3 until the tapered bottom portion 101*a* of the locking head 101 is engaged with the arcuate tongue plate 533 resiliently held in grip 12 by spring 532, thereby folding the umbrella of the present invention ready for the next opening operation as shown in FIG. 1.

The present invention is superior to the prior art as previously filed by the present inventor with the advantages of: a stable folding for locking the lower ferrule 16 towards the grip 12 to prevent an unexpected opening of the ribs; and a more stable extending of ribs and opening of umbrella because the three ferrules 18, 17, 16 are respectively held on the shaft means 1.

I claim:

1. An automatic umbrella comprising:

a central shaft means including a lower shaft having a grip secured on a lower portion of said lower shaft, a middle tubular shaft telescopically mounted in said lower tubular shaft having a middle plug fixed on a lower end portion of said middle tubular shaft, and an upper tubular shaft telescopically mounted in said middle tubular shaft having an upper plub fixed on a lower end portion of said upper tubular shaft;

a rib assembly including at least a top rib having an inner end portion of said top rib pivotally secured to an upper ferrule fixed on an upper end portion of said middle tubular shaft, at least a stretcher rib having an inner end portion of said stretcher rib pivotally secured to a lower ferrule slidably held on said lower tubular shaft and having an outer portion of said stretcher rib pivotally secured to said top rib, and at least an intermediate linking rib pivotally secured between said stretcher rib and a middle ferrule fixed on an upper end portion of said lower tubular shaft;

an opening tensioning spring formed in said central shaft means for opening said umbrella having an upper spring end portion retained on said middle plug of said middle shaft and having a lower spring end portion retained on a lower retainer formed on a lower portion of a central rod of which an upper most end portion of said central rod is secured to said upper plug of said upper shaft, an upper retainer formed on an upper portion of said rod operatively retaining said lower plug, and a locking head formed on a lowermost end portion of said rod below said lower retainer; at least a retraction restoring spring each secured between said middle ferrule and an outer portion of said rib assembly for retracting said rib assembly when closing said umbrella; and a control means formed in said grip having a push button for selectively depressing an opening controller for opening the automatic umbrella, or depressing a closing controller for closing the umbrella;

said lower ferrule having an extension ring formed on a lower portion of said lower ferrule engageable with an upper hook portion of said opening controller for pulling said lower and middle ferrules and said rib assembly downwardly along said central shaft means for retracting said rib assembly for extending said tensioning spring for storing its elastic potential energy, and upon adisengagement of said extension ring of said lower ferrule from said hook portion of said opening controller, said tensioning spring will restore to lower said middle shaft and said upper ferrule and raise said middle and middle ferrules for extending said rib assembly for opening said umbrella.

2. An automatic umbrella according to claim 1, wherein said locking head of said central rod is normally locked by a sliding latch transversely resiliently retained in said grip, and operatively depressed by said closing controller of said control means for closing the umbrella.

3. An automatic umbrella according to claim 1, wherein said central rod has an upper portion passing through a central rod hole formed in said lower plug.

4. An automatic umbrella according to claim 1, wherein said retraction restoring spring is operatively tensioned, when said opening tensioning spring has been restored to extend said rib assembly for opening the umbrella, to store an elastic potential energy in order for retracting said rib assembly when closing said umbrella.

5. An automatic umbrella according to claim 1, wherein said closing controller includes a sliding latch having an arcuate tongue plate recessed from said latch to be operatively engaged with said locking head of said central rod.

* * * * *